US008061172B2

(12) United States Patent
Gravier

(10) Patent No.: US 8,061,172 B2
(45) Date of Patent: Nov. 22, 2011

(54) SHEET METAL BENDING MACHINE AND PRODUCTION LINE INCORPORATING A MACHINE OF THIS TYPE

(75) Inventor: Michel Gravier, Nezel (FR)

(73) Assignee: Conception Machines Faveyrial, Cebazat (FR)

( * ) Notice: Subject to any disclaimer, the term of this patent is extended or adjusted under 35 U.S.C. 154(b) by 835 days.

(21) Appl. No.: 11/666,162

(22) PCT Filed: Oct. 24, 2005

(86) PCT No.: PCT/FR2005/002649

§ 371 (c)(1),
(2), (4) Date: Apr. 25, 2007

(87) PCT Pub. No.: WO2006/045942

PCT Pub. Date: May 4, 2006

(65) Prior Publication Data

US 2008/0047316 A1 Feb. 28, 2008

(30) Foreign Application Priority Data

Oct. 25, 2004 (FR) ..... 04 11359

(51) Int. Cl.
*B21D 5/14* (2006.01)
*B21D 9/10* (2006.01)

(52) U.S. Cl. ..... 72/173; 72/171; 72/241.4

(58) Field of Classification Search ..... 72/166, 72/170, 172, 173, 241.4, 241.6, 171, 174, 72/237, 240

See application file for complete search history.

(56) References Cited

U.S. PATENT DOCUMENTS 1,614,425 A * 1/1927 Coe ..... 72/241.4
5,115,658 A * 5/1992 Kirchhoff et al. ..... 72/175

FOREIGN PATENT DOCUMENTS

| | | |
|---|---|---|
| EP | 0 477 751 | 4/1992 |
| FR | 1 555 881 | 1/1969 |
| WO | WO 97 27957 | 8/1997 |

* cited by examiner

*Primary Examiner* — Debra Sullivan
(74) *Attorney, Agent, or Firm* — Dowell & Dowell, PC

(57) ABSTRACT

A roll bender machine for bending metal sheets which includes a roller driven in rotation and about which the sheet metal is rolled and at least two backing rollers adapted to receive and bear against a sheet while it is being bent around the roller. The backing rollers are mounted to rotate on a support that is adjustable. The bending roller and backing rollers are each associated with at least one set of devices for compensating their deflection. An arm is mounted on the machine for receiving coiled sheet metal and is provided with a housing in which the bending roller is at least partially received.

11 Claims, 6 Drawing Sheets

SHEET METAL BENDING MACHINE AND PRODUCTION LINE INCORPORATING A MACHINE OF THIS TYPE

BACKGROUND OF THE INVENTION

1. Field of the Invention

The invention relates to a machine for bending metal sheets, and more particularly to a machine of the roll bender type. The invention also relates to a line for fabricating tubes or cylinders by bending sheets, the installation incorporating a bending machine. The term "roll bender" designates any machine enabling a tube or ferrule to be made from a metal plate of small thickness, in particular a metal sheet. Tubes or ferrules are made from sheets by bending, i.e. the sheet is curved about a radius of curvature corresponding to that of the tube or the ferrule. In particular, the invention relates to roll benders for making tubes or ferrules of diameter that is as small as possible as a function of the length of the tube and the thickness of its wall, for example tubes having a diameter of 60 millimeters (mm) for a length of about 1 meter (m), and a thickness of 0.5 mm.

2. Description of the Related Art

FR-B-2 750 061 discloses roll benders each comprising a bending roller that is driven in rotation and about which the metal sheet is rolled, together with two backing rollers that are parallel to the bending roller and that serve to provide an adjustable passage between the various rollers so as to guide the metal sheet and impart the desired radius of curvature thereto. The outside diameter of the bending roller determines the minimum diameter of the tube or ferrule that can be obtained in a single revolution using the roll bender. The inside diameter of the tube or ferrule as formed in this way varies in particular as a function of the elastic limit of the metal or metal alloy constituting the sheet; the higher the limit, the greater the final diameter of the tube, with the tube tending to return to its initial shape. For example, with ordinary steels, the minimum diameter of the tube is about 1.2 times the diameter of the bending roller. With titanium, that presents a high elastic limit, the minimum diameter of the tube is about five times the diameter of the bending roller. To make a stainless steel tube with an inside diameter of 80 mm, of the kind used for flue lining, the diameter of the bending roller must be 1.4 times smaller, i.e. it must be about 55 mm.

Given the stresses to which it is subjected during a rolling operation, a bending roller of this diameter, having a length close to one meter, does not remain rectilinear, but tends to present significant deflection. Similarly, the backing rollers tend to present deflection. Depending on the stresses exerted by the metal sheet, this problem of deflection can also be accompanied by the bending roller beginning to become twisted.

When the bending and backing rollers present deflection, the resulting tube is enlarged in its middle. It is said to be "barrel-shaped".

FR-B-2 750 061 describes a solution for overcoming the deflection of backing rollers by using a plurality of short backing rollers in alignment, or in a variant, by using backing rollers of length close to that of the bending roller and resting against a plurality of small rollers.

EP-A-0 477 751 describes a top roller and a bottom roller, the bottom roller being flanked by two parallel rollers. Adjustable wheels carried by beams and movable in sliders bear in adjustable manner against the rollers situated in the bottom portion in order to compensate the deflection thereof.

Those devices enable deflection to be compensated only of the backing rollers. The amount of compensation is not under control, and deflection of the bending roller is not compensated at all. Such a system does not enable tubes to be obtained that are genuinely cylindrical with a diameter close to 80 mm and a length close to 1.20 m.

SUMMARY OF THE INVENTION

The invention seeks in particular to remedy that drawback by proposing a roll bender adapted to making tubes that are cylindrical and that present a large ratio of length over diameter.

To this end, the invention provides a roll bender type machine for bending metal sheets, the machine comprising firstly a bending roller driven in rotation and about which the sheet metal is rolled, and secondly at least two backing rollers adapted to receive and bear against a sheet while it is being bent around said bending roller, said backing rollers being mounted to rotate freely on a support that is adjustable in height so as to adapt the clearance between said bending roller and said backing rollers to the thickness of said sheet, said bending roller being associated with at least one set of means for compensating its deflection, at least in part, said backing rollers being associated with at least one set of means for compensating their deflection, said set being adjustable depending on the residual deflection of said bending roller, the machine being characterized in that said set of means for compensating the deflection of said bending roller comprises an arm provided with a housing in which said roller is received in part, together with means for holding said roller in said housing.

Such a roll bender makes it possible to compensate in coordinated manner for the deflections of the various rollers, and thus to form tubes that are cylindrical.

According to features of the invention that are advantageous but not essential, the machine may incorporate one or more of the following characteristics:

- the housing is a groove having distributed around its length at least three sets of means for holding the roller with minimum deflection while it is in rotation;
- each of the sets of holding means comprises two wheels bearing against the roller in a direction that is generally perpendicular to a main axis of the housing;
- the machine includes at least three sets of means for compensating the deflection of the backing rollers;
- each of the sets of compensation means comprises at least three juxtaposed ball bearings secured to a support that is adjustable in height, e.g. by means of a sloping spacer; each of the sets of compensation means is adjustable in height individually by means of a micrometer screw;
- all of the sets of compensation means are slidably mounted on a single base, itself adjustable in height by means of at least two sloping spacers;
- the sets of means for holding the bending roller are disposed substantially in a staggered configuration relative to the set of compensation means for the backing rollers; and
- the bending roller is supported by an arm with which it is releasably mounted on the machine.

The invention also provides a line for fabricating tubes or cylinders by bending metal sheets and including at least one machine for bending metal sheets that is made in accordance with any preceding characteristic.

BRIEF DESCRIPTION OF THE SEVERAL VIEWS OF THE DRAWINGS

The invention can be better understood and other advantages thereof appear more clearly on reading the following description of an embodiment of a machine of the invention for bending sheet metal, given purely by way of example and made with reference to the accompanying drawings, in which.

DETAILED DESCRIPTION OF THE PREFERRED EMBODIMENTS OF THE INVENTION

Figure 1:
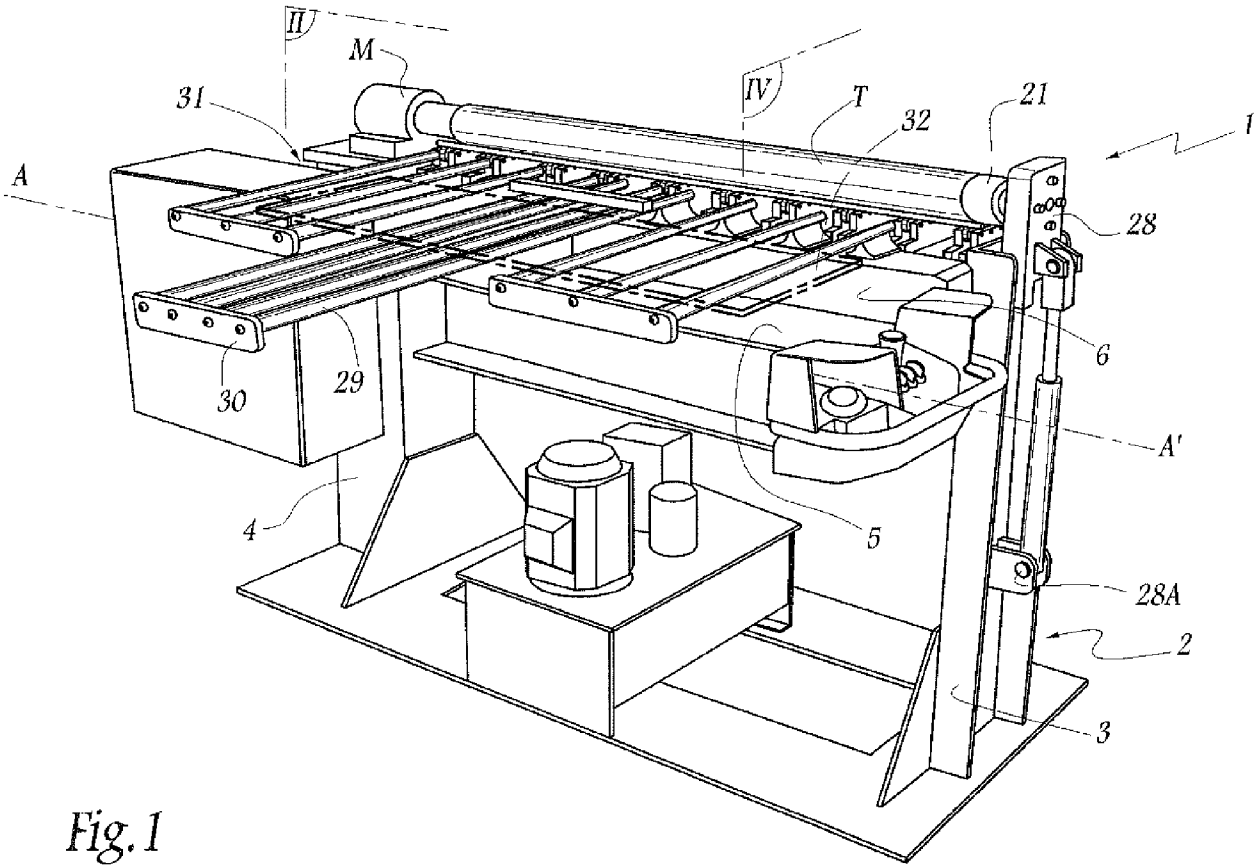
FIG. 1 is a simplified perspective view of a machine constituting an embodiment of the invention, the sheet metal being shown prior to bending, drawn in chain-dotted lines.

The sheet metal bending machine 1, known as a "roll bender", shown in FIG. 1 comprises a main body 2 that is generally H-shaped. The spacing between the uprights 3 and 4 of the H-shape is adapted to the final length of the tube T that it is desired to make. The transverse bar or beam 5 of the body 2 of the machine supports a stationary crossbar 6 that is held generally horizontal. The crossbar 6 is provided on its top face with three notches 7 that are inclined at about 45° relative to a longitudinal axis A-A' of the beam 5. The crossbar 6 is movable longitudinally by a hydraulic device 60 in a direction parallel to the axis A-A'.

A second crossbar 9 fitted on its bottom face with at least two spacers 8 is placed on the crossbar 6. Thus, when the crossbar 6 is moved simultaneously with the spacers 8 from right to left or from left to right in FIG. 2, the crossbar 6, the spacers 8 slide on the slope of the notches 7 on which they rest and cause the crossbar 9 to move up or down in a direction that is generally perpendicular to the axis A-A' and parallel to the plane of FIG. 2. This device serves to transform horizontal movement into vertical movement.

Figure 6:
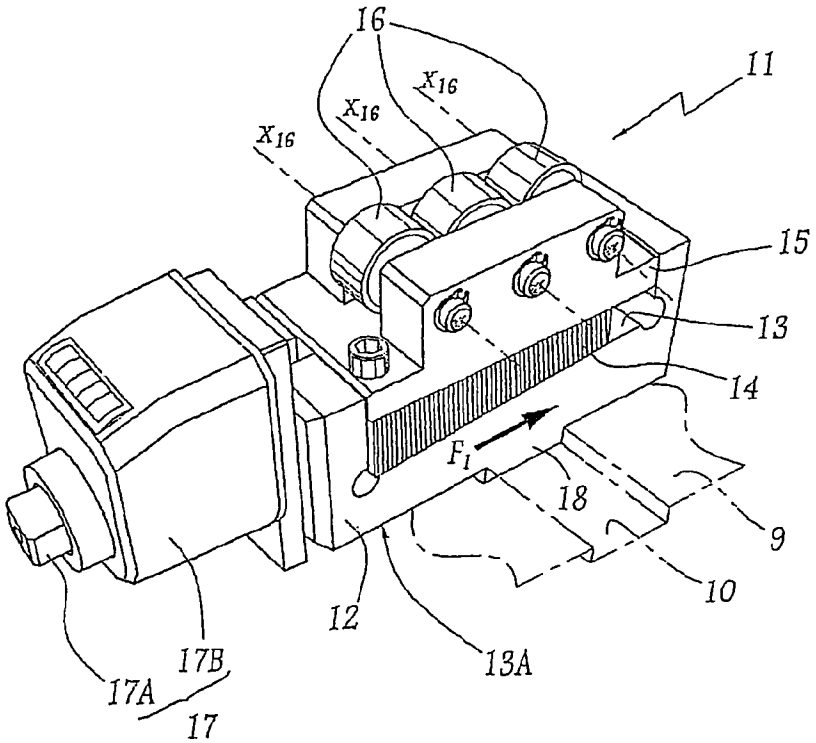
FIG. 6 is a perspective view of a set of means for compensating deflection in the backing rollers, the groove in which said unit is received being drawn in chain-dotted lines.
Figure 3:
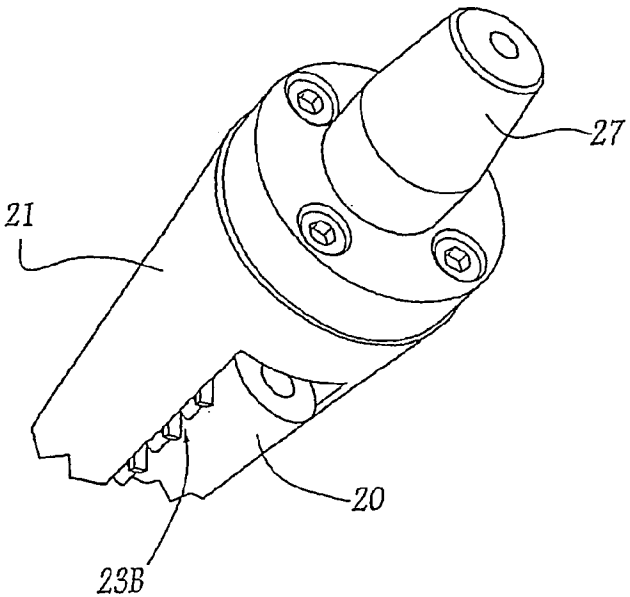
FIG. 3 is a fragmentary view from beneath in perspective showing the bending roller and certain means for compensating its deflection.

On its top face, the crossbar 9 is provided with a longitudinal groove 10. For greater clarity, the groove is drawn in chain-dotted lines in FIG. 6. Members 11 of means for compensating the deflection of the backing rollers are engaged in part in the groove 10 and are movable therein.

Each of the sets or members 11 comprises a main body 12 that is generally in the form of a flat-bottomed U-shape. The bottom face 13 of the bottom is inclined. A sloping spacer or "wedge" 14 whose inclined face has a slope that is substantially identical to that of the face 13, is positioned on the bottom of the main body 12. A frame 15 is placed on the top face of the spacer 14. The frame supports three juxtaposed ball bearings 16 having axes of rotation $X_{16}$ that are parallel and that extend in a direction that is generally perpendicular to the plane of FIG. 4. The ball bearings 16 thus form a rolling path that is generally parallel to the slope of the bottom 13.

An adjustment device 17 comprising a micrometer screw 17A and fitted with a counter 17B is mounted on a flange of the body 12. The device 17 is not shown in FIG. 4 in order to clarify the drawing. The end of the screw 17A is connected to one side of the sloping spacer 14. Thus, by screwing the screw 17A in or out, its end penetrates to a greater or lesser extent into the space that extends between the flanges of the body 12, and it pushes the spacer 14 towards the other flange of the body 12. This displacement $F_1$ of the spacer 14 takes place on the sloping face of the bottom 13, thereby having the effect of raising or lowering the frame 15 which is placed on the top face of the spacer 14. This vertical movement is represented by double-headed arrow $F_2$ in FIG. 4.

A portion in relief 18 projects from the outside face of the bottom 13A. It is of a shape that is adapted to be inserted with little clearance, and to slide in the groove 10 of the crossbar 9. The spacing between the members 11 is adjusted so that when they are in position in the groove 10, the ball bearings 16 are regularly spaced apart parallel to the axis A-A'.

Two solid or hollow circular-section cylindrical rods 19 that are preferably made of a metal or metal alloy that is stainless are placed on the rolling path formed by the ball bearings 16. These rods constitute the backing rollers 19 of the machine. They are mounted to be free to rotate, while being held at their ends in housings formed in vertical uprights secured to the crossbar 9. The backing rollers 19 are placed in such a manner that, at each member 11, each roller 19 is supported by two juxtaposed ball bearings 16. In this configuration, the longitudinal axes $X_{19}$ of the rollers 19 and the longitudinal axes $X_{16}$ of the ball bearings 16 are generally parallel to the axis A-A' of the crossbar 6. The rollers 19 and the ball bearings 16 are driven in rotation relative to one another by friction.

The top portion of the main body 2 of the machine receives the bending roller 20 about which sheet metal becomes rolled on being bent. The axis $X_{20}$ of the roller 20 is placed in a direction that is generally parallel to the axis A-A'. The roller 20 is held as rectilinearly as possible by means for compensating its deflection.

These deflection compensation means comprise an arm 21 of outside shape that is in the form of a solid cylinder of circular section, and it is made of a material that is rigid and elastic. This arm 21 presents a large second moment of area, i.e. it remains generally rectilinear, or at least it deflects little when subjected to stress, and in particular to a bending force. Advantageously, its outside diameter lies generally in the range three to six times the outside diameter of the bending roller 20.

This arm 21 is provided over practically its entire length with a longitudinal groove 22. The groove 22 has a flat bottom. The width of the groove 22 is significantly greater than the diameter of the bending roller 20.

The groove 22 is suitable for receiving members that provide bearing contact between the roller 20 and the arm 21.

Figure 2:
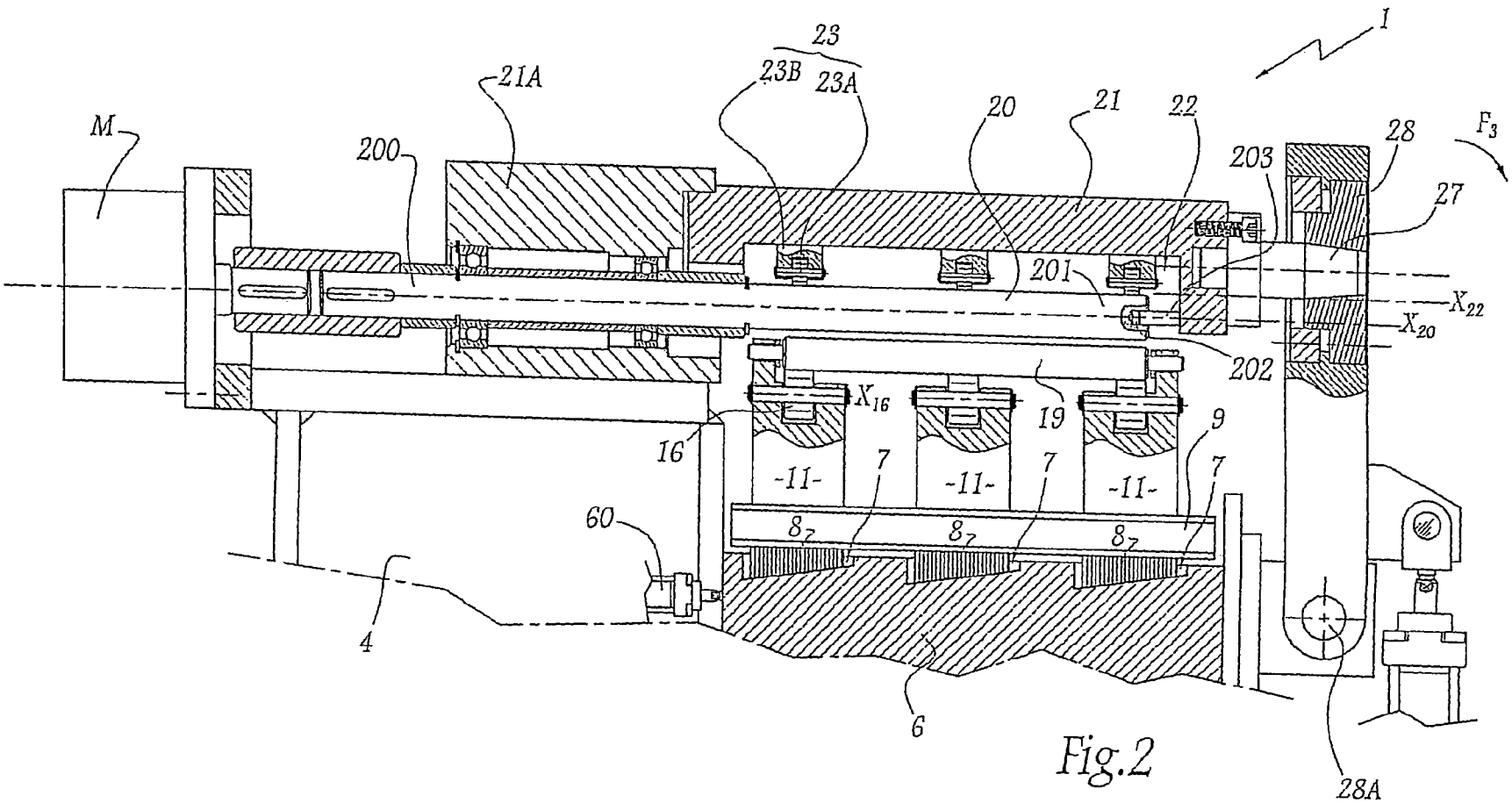
FIG. 2 is a fragmentary section on plane II showing the top portion of the machine shown in FIG. 1, and for greater clarity only the three sets of bending roller holder means and the three sets of compensation means for a backing roller are shown.

A plurality of support subassemblies 23 for the roller 20 are distributed along the length of the groove 22. Three subassemblies 23, this being a minimum number, are shown in FIG. 2, however the number of subassemblies can be varied and is selected when designing the roll bender 1.

Within each subassembly 23, wheels 23A are mounted on a cradle 23B. The cradle 23B presents a generally flat-bottomed U-shape. The outside shape and dimensions of the cradle 23B match the shape and dimensions of the groove 22. The inside shapes and dimensions of the cradle 23B are adapted to fit closely around the circumference of the roller 20, without making contact therewith.

Figure 5:
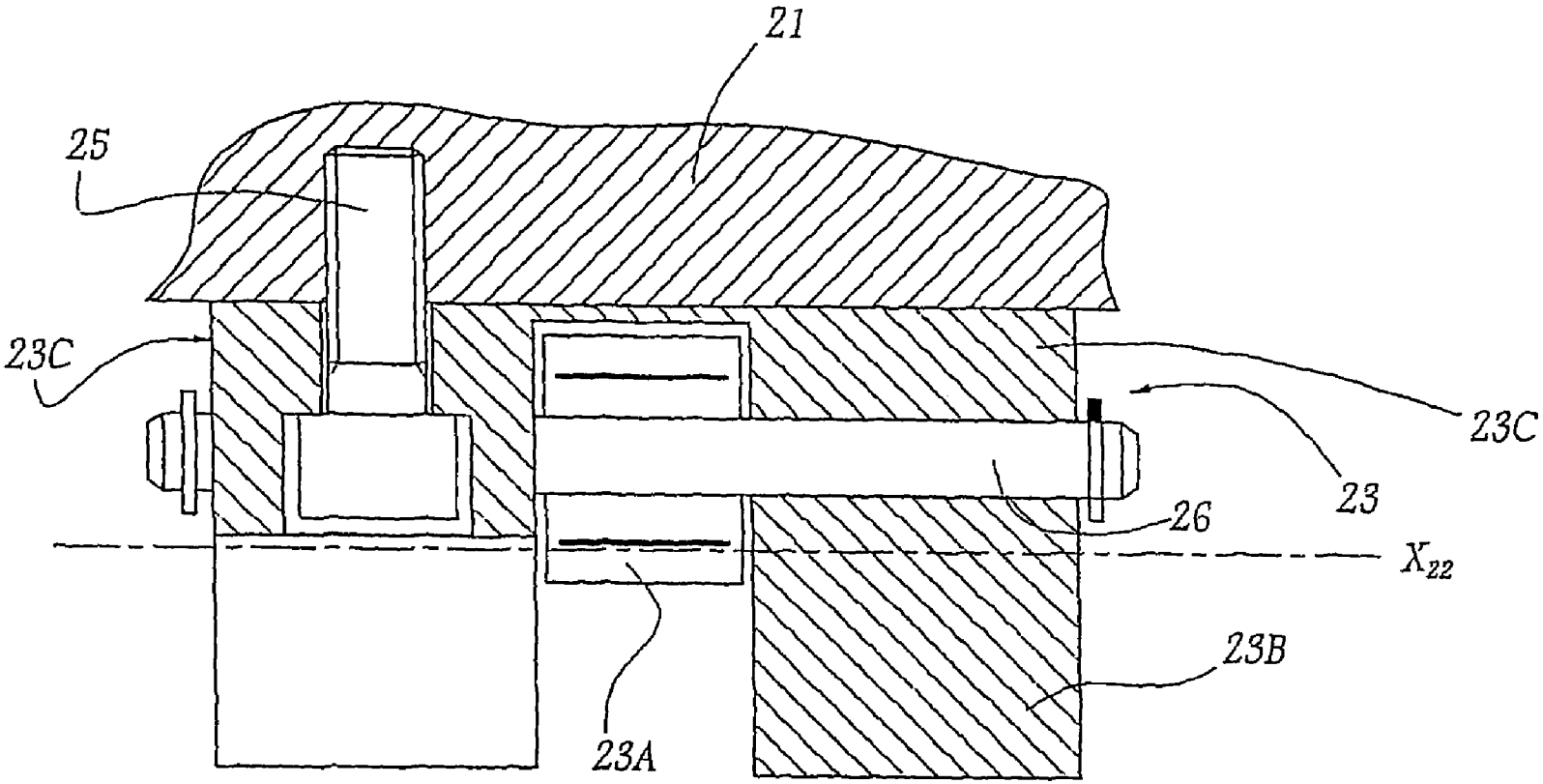
FIG. 5 is a fragmentary longitudinal section on a different scale on line V-V of FIG. 4, showing a system for holding the bending roller in a deflection-compensation member.
Figure 7:
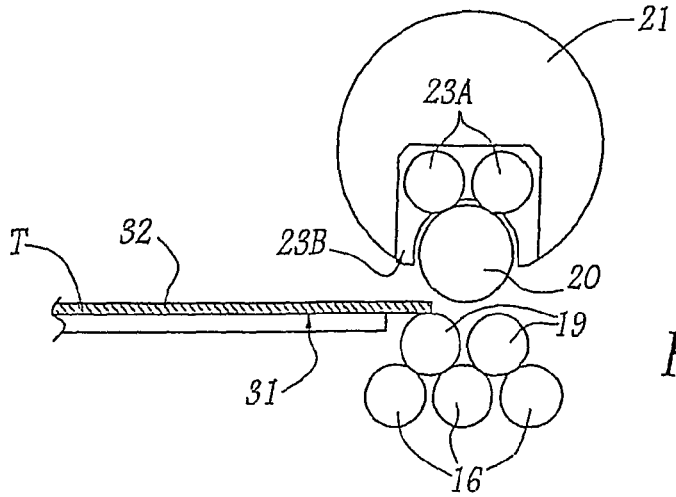
FIGS. 7 to 9 are diagrams showing different stages in bending a metal sheet.
Figure 8:
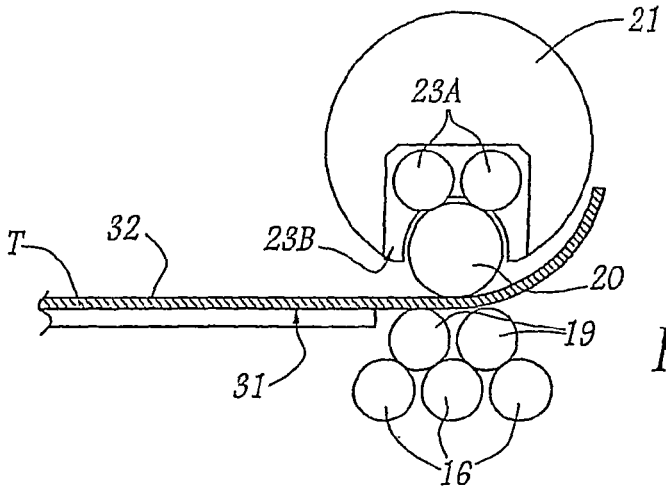
Figure 9:
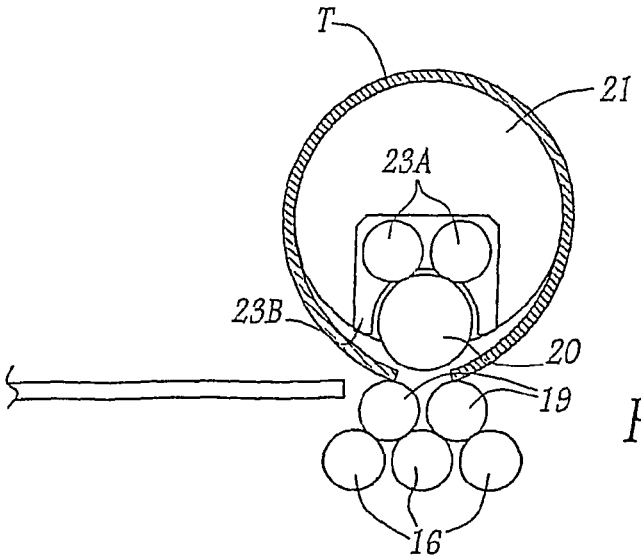

FIG. 5 is a section in two different planes of the cradle 23B, lying firstly in the midplane of the cradle 23B (left-hand side of the figure), and secondly in the midplane of a pin 26 supporting a wheel 23A (right-hand portion of the figure).

The wheels 23A are mounted in pairs on each cradle 23B. A screw 25 passes through the bottom of the cradle 23B and secures it to the bottom of the groove 22. When the cradles 23B are in place in the groove 22, each of the wheels 23A is free to rotate about a pin 26 held in two bearings 23C formed in the cradle 23B. The pins 26 extend in a direction parallel to the longitudinal axis $X_{22}$ of the groove 22.

The groove 22 formed in the arm 21 is thus fitted with at least three subassemblies 23, each carrying two wheels 23A. The inside dimensions of each of the cradles 23B are adapted to cover the roller 20 in part and with minimal clearance. On each cradle 23B, the wheels 23A are mounted so as to make contact continuously with the roller 20, while allowing the roller 20 and the wheels 23A bearing against the roller 20 to rotate freely.

The roller is held in each of the cradles 23B situated in the groove 22 via the ends 200, 201 of the roller 20. One end 200 is connected to a rotary drive member, e.g. an electric or hydraulic motor M. The other end 201 is provided with a housing 202 in which there is engaged a portion in relief or a rod 203 secured to one end of the arm 21. The dimensions of the housing 202 and of the rod 203 are suitable for allowing the roller 20 to rotate freely, thus making it possible when the roller 20 is rotating and is under stress, to keep the roller as straight as possible.

When the roller 20 is bearing against the wheels 23A and is in place in the groove 22, a portion of its circumference, i.e. about 20%, is situated outside the groove 22, and thus outside the arm 21. This portion of the roller forms the active zone thereof, i.e. the zone that is suitable for bending sheet metal.

The assembly formed by the roller 20 and the arm 21 is located in the top portion of the machine 1 between the free ends of the uprights 3 and 4 of the main body 2. At its end 200, the roller 20 is connected to the rotary drive motor M via an orifice formed through the root portion 21A of the arm 21.

The arm 21 is secured to the main body, e.g. by bolting at one of its ends. The other end of the sleeve 21 is provided with a frustoconical mandrel 27. When the roller 20 is rotating, this mandrel is received in a moving arm 28. A pivoting movement of the arm 28 about a pin 28A secured to the body 2 enables the mandrel 27 to be disengaged and enables the end of the arm 21 to be released. This movement is represented by arrow $F_3$ in FIG. 2.

The assembly formed by the roller 20 and the arm 21 is positioned in stationary manner above the two backing rollers 19. These rollers are adjusted in height so that the space between the rollers 20 and 19 corresponds overall to the thickness of the sheet metal that is to be bent.

This space is adjusted by moving the crossbar 9 vertically by displacing the spacers 8 in the notches 7.

One side of the machine, in the top portion thereof, is fitted with a plurality of parallel tubes 29 extending in a direction that is generally perpendicular to the axis A-A'. These tubes 29 are connected together by crossbars 30 and thus form a plane or table 31 for feeding the machine. The dimensions of this feeder table are adapted to the dimensions of the metal sheets 32 that are to be bent.

The bars 29 are also provided with adjustable stops (not shown) serving to hold a sheet 32 on the feeder plane 31 so that the longitudinal axis of the sheet 32 is substantially parallel to the axis A-A'.

Advantageously, the bars forming the feeder plane 31 are secured to the crossbar 9 that carries the backing rollers 19. In this way, adjusting the height of the space between the bending roller 20 and the backing rollers 19 as a function of the thickness of the metal sheet gives rise to a concomitant movement of the feeder plane 31. In this way, a sheet 32 present on the feeder plane 31 always has one of its edges facing the space formed between the roller 20 and at least one of the rollers 19.

When a sheet 32 is positioned on the table 31 with a roller 19 in contact with the sheet 32, and when the roller 20 is driven in rotation, the sheet 32 is driven between the roller 20 and one of the rollers 19. This passage of the sheet 32 between the rollers causes the sheet to be bent, i.e. imparts curvature thereto that corresponds overall to the radius of the circle passing between the three rollers 19 and 20. Bending is performed over the entire length of the sheet and over its entire width. Thus, at the end of bending, the sheet 32 is rolled up once around the arm 21. It then suffices to move the pivot arm 28 in the direction of arrow $F_3$ to be able to disengage the arm 31 and cause the tube T that has been formed in this way to slide away from the machine 1.

It is possible to remove the tube T in automatic manner. Under such circumstances, the tube T is taken to a welding station that serves to weld together its two edges.

Advantageously, with such a configuration, for stainless steels 32 having thickness lying in the range 0.4 mm to 0.6 mm, tubes T can be made having a diameter of 60 mm and a length of 1 m, or a diameter of 75 mm and a length of 1.20 m.

While the sheet is being bent, the forces to which the rollers 19 and 20 are subjected in order to obtain the final tube, given the respective diameter/length ratio thereof and the thickness of the sheet, tend to cause the rollers 19 and 20 to deflect. This deflection is compensated by the large second moment of area of the arm 21 and by the wheels 23A bearing against the roller 20 and the support given by the ball bearings 16 to the rollers 19.

Figure 4:
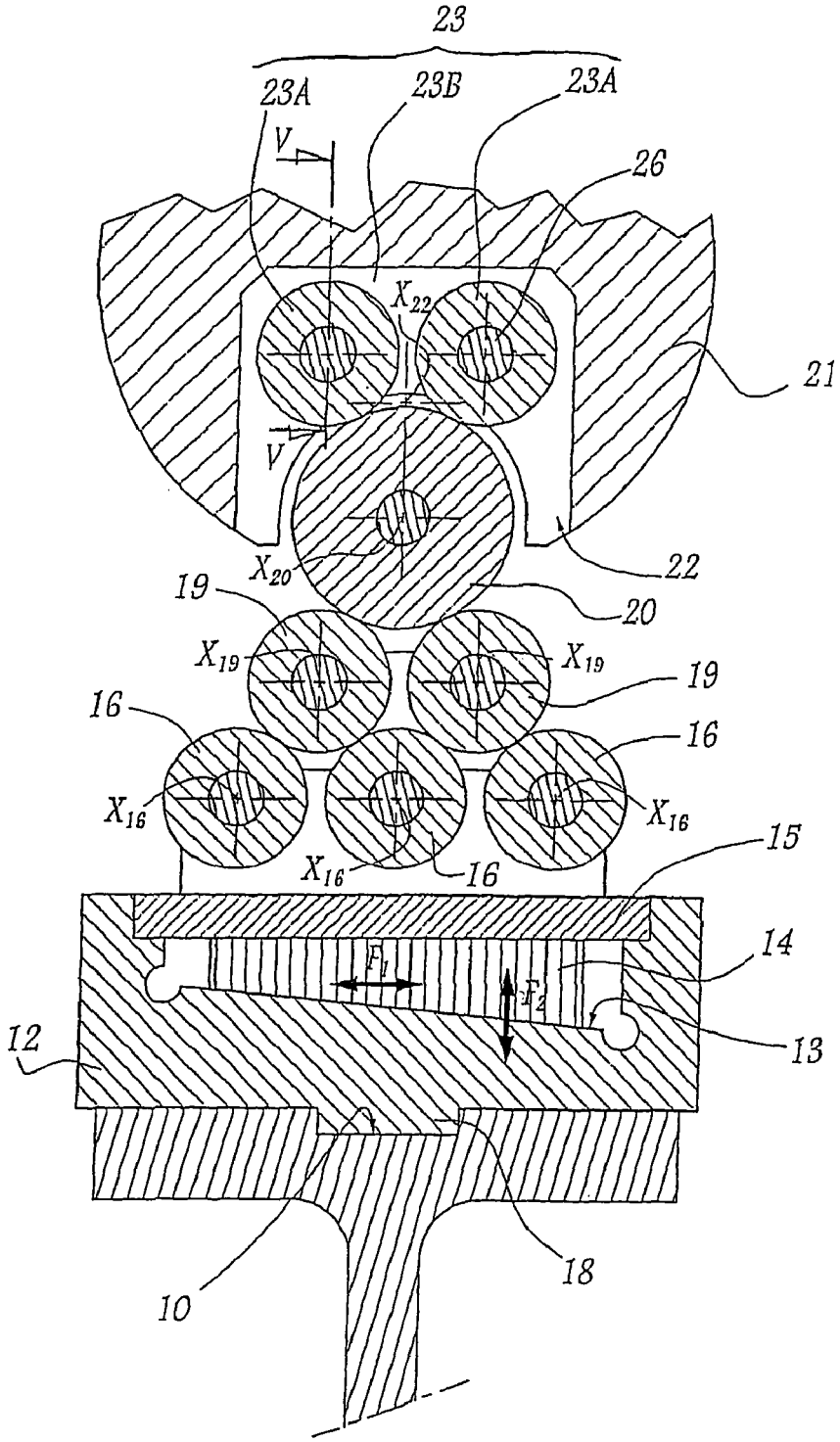
FIG. 4 is a fragmentary section on a larger scale on line IV-IV of FIG. 1.

In particular, the bending roller 20 is held at both of its ends, and the stress exerted by the sheet 32 is directed upwards in FIG. 4. The roller 20 tends to deflect with its concave side facing towards the stand of the machine 1. In analogous manner, the backing rollers 19 take on deflection in the opposite direction, i.e. deflection with a radius that is generally equivalent and with a concave side facing towards the top of the machine 1. These deflections are controlled and compensated in adjustable manner by the various means described above.

The bending roller 20 is held by the wheels 23A supported by the solid arm 21 whose outside diameter and mass provide sufficient resistance for it to deflect little under the forces to which it is subjected while bending the sheet 32. The roller 20 thus takes on so-called "residual" deflection corresponding to the deflection that is not compensated by the arm 21.

In analogous manner, the backing rollers 19 are supported by the ball bearings 16. By means of the adjustment device 17, the ball bearings 16 are caused to bear firmly against the rollers 19. This backing force is distributed locally along the length of the rollers 19. This enables the rollers 19 to be given inverse deflection, corresponding to the residual deflection of the roller 20, so as to keep the space between the rollers 19 and 20 constant at all respective lengths thereof.

By maintaining a constant space in this way in adjustable manner between the rollers 19 and 20, it is possible to obtain cylindrical tubes T presenting generator lines that are rectilinear, regardless of the sheet 32 that is used.

Depending on the length of the rollers 19 and 20 that are used and on the thickness of the sheet 32, and thus on the stress exerted thereby, it is easy to calculate the adjustment and the number of compensation means 11 and 23 needed to compensate for the deflections of the rollers 19 and 20.

By way of example, for rollers that are about 1.20 m long and 20 mm in diameter, twelve compensation members 11 are regularly distributed over the rollers 19. In the sleeve 21 of the roller 20, twelve subassemblies 23B are likewise regularly spaced apart. Advantageously, the subassemblies 23B and the members 11 are disposed in a staggered configuration. In this way, on being set into rotation, the various rollers 19 and 20 are held properly over the major portions of their respective lengths.

In addition, the presence of an arm 21 partially covering the bending roller 20 makes it possible to reduce the risk of a limb or a garment of a user of the machine 1 being pinched and driven through. The arm 21 thus also contributes to making the machine safer to use.

The arm 21 and the roller 20 are easily removed, for example in order to be replaced by another sleeve and/or roller assembly of different diameter.

In other embodiments (not shown), the means for compensating the deflections of the backing rollers 19 are adjusted in a manner that is different from that described. The device may be electrical, hydraulic, or placed on a threaded rod.

The invention claimed is:

1. A roll bender machine for bending metal sheets, the machine comprising a bending roller driven in rotation and about which sheet metal is rolled, and at least two backing rollers adapted to receive and bear against the sheet metal while it is being bent around the bending roller, the at least two backing rollers being mounted to rotate freely on a support that is adjustable in height so as to adapt the clearance between said bending roller and the at least two backing rollers to the thickness of the sheet metal, the bending roller being associated with at least one first set of means for compensating its deflection, at least in part, the at least two backing rollers being associated with at least one second set of means for compensating their deflection, the at least one second set being adjustable depending on a residual deflection of the bending roller, the at least one first set of means for compensating the deflection of the bending roller including an arm provided with a housing in which the bending roller is received in part, together with means for holding the bending roller in the housing, the arm having an outer shape in a form of a cylinder of circular cross section and around which bent metal sheet passing from between the bending roller and the at least two backing rollers is received, and the arm being secured, at one end thereof, to a main body of the machine and, at an opposite end thereof, including a mandrel mounted to a movable support arm so that, when the support arm moves from the mandrel, bent metal sheet carried on the arm may be removed from the arm.

2. A machine according to claim 1, wherein the housing is a groove having positioned along its length at least three first sets of means for holding the bending roller with minimum deflection while the bending roller is in rotation.

3. A machine according to claim 1, wherein the at least one first set of means for compensating includes two wheels bearing against the bending roller in a direction that is generally perpendicular to a main axis ($X_{22}$) of the housing.

4. A machine according to claim 1, including at least three second sets of means for compensating the deflection of the at least two backing rollers.

5. A machine according to claim 4, wherein each of the at least three second sets of compensation means includes at least three juxtaposed ball bearings secured to a support that is adjustable in height by a sloping spacer.

6. A machine according to claim 4, wherein each of the at least three second sets of compensation means is adjustable in height individually by means of a micrometer screw.

7. A machine according to claim 4, wherein all of the at least three second sets of compensation means are slidably mounted on a single base which is adjustable in height by means of at least two sloping spacers.

8. A machine according to claim 1, wherein the means for holding the bending roller are disposed substantially in a staggered configuration relative to the at least one second set of compensation means for the at least two backing rollers.

9. A machine according to claim 1, wherein the bending roller supported by the arm is releasably mounted on the machine.

10. A line for fabricating tubes or cylinders by bending metal sheets, the line including at least one machine for bending the metal sheets made in accordance with claim 1.

11. A roll bender machine for bending metal sheets, the machine comprising a bending roller driven in rotation and about which sheet metal is rolled and at least two backing rollers adapted to bear against the sheet metal while the sheet metal is being bent around the bending roller, at least three sets of means for compensative deflecting of the at least two backing rollers as sheet metal passes between the bending roller and the at least two backing rollers, and wherein the at least three sets of compensation means are slidably mounted on a single base which is adjustable in height by means of at least two sloping spacers.

* * * * *